United States Patent [19]

Levasseur

[11] Patent Number: 4,838,406

[45] Date of Patent: Jun. 13, 1989

[54] COIN DIVERTING ASSEMBLY

[75] Inventor: Joseph L. Levasseur, Chesterfield, Mo.

[73] Assignee: Coin Acceptors, Inc., St. Louis, Mo.

[21] Appl. No.: 233,887

[22] Filed: Aug. 16, 1988

Related U.S. Application Data

[63] Continuation of Ser. No. 922,830, Oct. 22, 1986, abandoned, which is a continuation of Ser. No. 659,368, Oct. 10, 1984, abandoned.

[51] Int. Cl.[4] ..... G07F 1/04

[52] U.S. Cl. ..... 194/346; 193/31 A

[58] Field of Search ..... 194/346; 221/7; 193/31 A, DIG. 1

[56] References Cited

U.S. PATENT DOCUMENTS

| | | | |
|---|---|---|---|
| 2,642,974 | 6/1953 | Ogle | 194/100 R |
| 3,092,308 | 6/1963 | Barnhart | 194/346 X |
| 3,215,239 | 11/1965 | Denzer | 194/346 |
| 3,746,211 | 7/1973 | Burgess | 221/7 |
| 3,837,139 | 9/1974 | Roseberg | 221/7 X |
| 4,386,690 | 6/1983 | McGough | 194/1 D |
| 4,503,961 | 3/1985 | Chittleborough | 194/1 C |

*Primary Examiner*—F. J. Bartuska

*Attorney, Agent, or Firm*—Cohn, Powell & Hind

[57] ABSTRACT

This coin divertor assembly includes a body providing a coin entry path and two coin exit paths. A gate member is mounted to the body at the end of the coin-entry path for selectively diverting a coin into one of the coin-exit paths. A holder maintains the gate in each of the gate positions in a stable equilibrium condition and an actuator provides an impulse force for moving the gate from one position of stable equilibrium to the other position of stable equilibrium.

14 Claims, 3 Drawing Sheets

COIN DIVERTING ASSEMBLY

This application is a continuation of Ser. No. 922,830, filed Oct. 22, 1986, now abandoned, which is a continuation of Ser. No. 659,368, filed Oct. 10, 1984, now abandoned.

BACKGROUND OF THE INVENTION

This invention relates generally to a coin diverting assembly and more particularly to an assembly which requires very low power for operation.

Coin diverting assemblies are commonly used in coin accepting systems for directing a coin into alternative paths, for example, into an acceptance path or a rejection path. In general, such devices commonly include a movable gate providing a divertor member which is moved between two positions and held in one or other of the positions for a specified period during passage of the coin. With such divertors it is necessary to apply power to hold the divertor member in the chosen position for the full duration required for the passage of the coin, usually by means of a solenoid. While this presents no problem in those instances in which the necessary power is available it presents a considerable problem when the only available power is insufficient to provide the holding force for the full duration required.

This divertor assembly overcomes this and other problems in a manner not disclosed in the known prior art.

SUMMARY OF THE INVENTION

This coin divertor assembly provides a bi-stable divertor member which is movable between two stable equilibrium positions to direct coins into alternative paths and is operable with the application of relatively low power, for a short time duration.

This coin divertor assembly includes a body defining a coin-entry path and first and second coin-exit paths; a divertor member mounted to the body and movable between a first, coin-directing stable equilibrium position leading from the coin-entry path to the first coin-exit path and a second coin-diverting stable equilibrium position leading from the coin-entry path to the second coin-exit path; the assembly also includes holding means tending to maintain the divertor member in a position of stable equilibrium and actuating means selectively providing an impulse force to move the divertor member from the first position to the second position.

It is an aspect of this invention to provide a holding means which utilizes a snap action spring.

It is still another aspect of this invention to provide a holding means which utilizes gravity action.

It is yet another aspect of this invention to provide a holding means which utilizes magnetic action.

It is an aspect of this invention to provide an actuating means which utilizes one or more solenoids to provide the impulse force to move the divertor member between the two positions of stable equilibrium.

It is an aspect of this invention to provide a divertor member including a hinged gate and a body having spaced abutment portions selectively engageable by the gate.

It is an aspect of this invention to provide a divertor assembly which can be used in those condition such as can exist in telephone call boxes in which available electric power is of small wattage and the temperature can be so low as to reduce available power even more.

It is still another aspect of this invention to provide a divertor assembly which utilizes mechanical and electrical components which are both simple and inexpensive.

DESCRIPTION OF THE PREFERRED EMBODIMENTS

Figure 1:
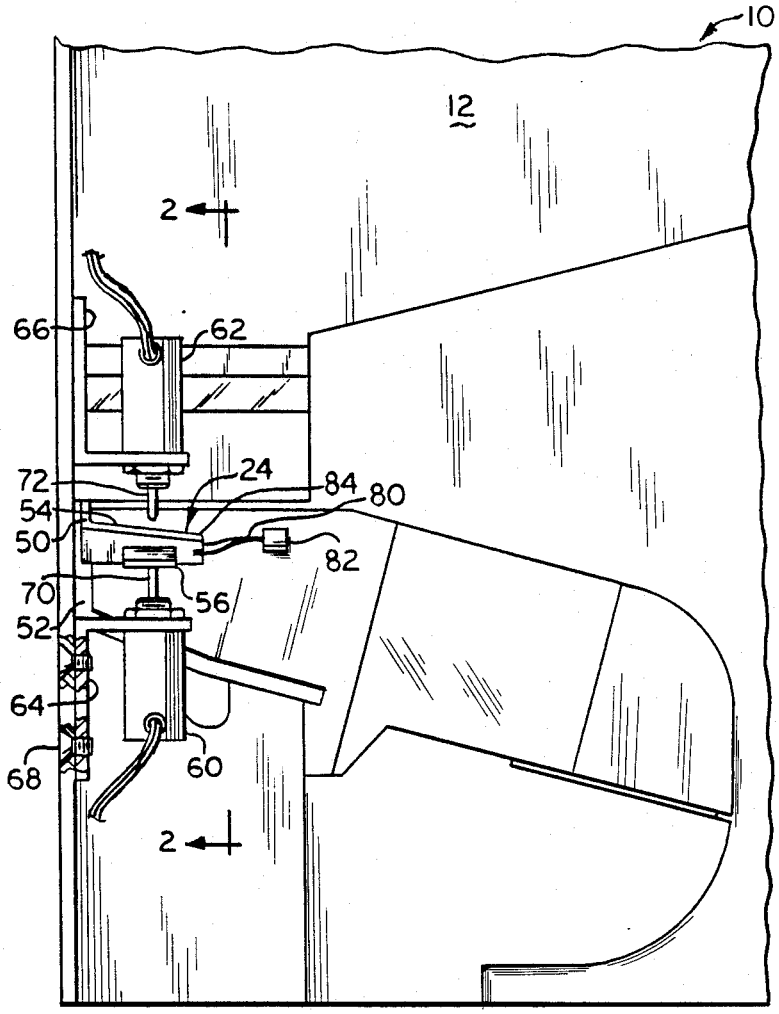
FIG. 1 is a fragmentary, elevational view of the divertor assembly illustrating the disposition of parts with the gate in position to direct coins into a first path.

Referring now by reference numerals to the drawings and first to FIGS. 1–4, it will be understood that the complete coin acceptor device 10 is not shown. Only such details of the device 10 are shown as are believed necessary to the explanation and description of those parts of the device which are pertinent to an understanding of the divertor assembly, which is intended to divert coins into a preselected path. Prior stages of the coin acceptor mechanism in which the coin is deposited into a suitable slot are omitted for clarity.

Figure 2:
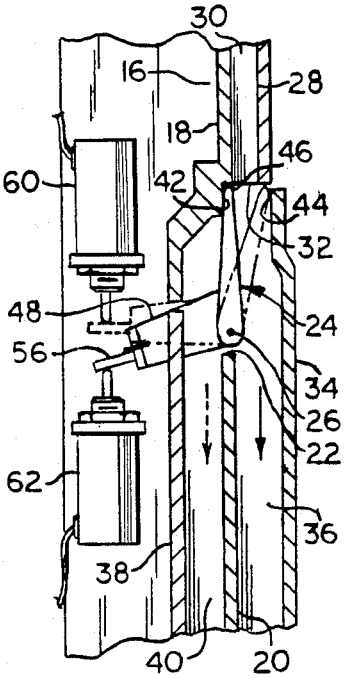
FIG. 2 is a fragmentary cross sectional view of the divertor taken on line 2—2 of FIG. 1 showing in phantom outline, the disposition of the gate to direct coins into a second path.

As shown in FIGS. 1 and 2 the coin divertor assembly includes a support plate 12 constituting a body. The support plate 12 includes a wall 16 having an upper portion 18 and a lower portion 20 which are separated by an opening 22. A gate 24 constituting a divertor member is hingedly mounted to the sides of the opening 22 for pivotal movement about a hinge pin 26 to selectively open and close said opening. An upper rear wall portion 28 is spaced from the upper wall portion 18 to define a coin-entry passage 30 and an end opening 32. A lower rear wall portion 34 is spaced from the lower wall portion 20 to define a first coin-exit passage 36 and a lower front wall portion 38 is spaced from the lower wall portion 20 to define a second coin-exit passage 40. The rear wall portion 34 includes an abutment 44 and the front wall portion 18 includes an abutment 42, said abutments 42 and 44 providing stop means selectively engageable by the remote end 46 of the gate 24.

In the embodiment shown the gate 24 includes a generally ell-shaped integrally formed bracket 48 having an outstanding leg 50, extending through an opening 52 in the front wall portion 38, and a right-angularly related leg 54 having an abutment lug 56. In the embodiment shown solenoids 60 and 62 are mounted on lower and upper bracket elements 64 and 66 respectively said brackets being fixedly attached to the support plate 12 as by fasteners 68. The solenoids 60 and 62 include plunger elements 70 and 72 respectively which are selectively engageable with the lower and upper sides of the gate abutment lug 56. An electrical impulse supplied selectively to one or other of the solenoids from an energy source provides power actuating means which applies a force to the gate capable of inducing movement into the gate 24 about the hinge pin 26.

Importantly, the gate 24 is held alternately in one of two positions of stable equilibrium. In the embodiment shown this is accomplished by means of a snap-spring element 80. This element 80 is connected at one end to a lug 82 projecting outwardly as from the wall portion 38 and connected at its other end to the remote end 84 of the gate bracket leg 54.

Figure 3:
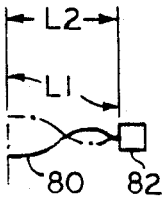
FIG. 3 is an enlarged view of a spring holding element shown in FIG. 1.

As shown in FIG. 3 the snap-spring element 80 has a free length L1. The perpendicular distance between the connection points provided at lug 82 and at the bracket leg remote end 84 is L2 which is less than L1 and the element is restrained against rotation at its ends. This structural arrangement of parts provides that the snap-spring element constitutes a holding means which will hold the gate 24 in the first position, shown in full outline in FIGS. 2 and 3, in which the gate is urged by the snap-spring against the abutment 42. This position is maintained until sufficient force is applied to the gate 24, against the resistance of the snap-spring element 80, to carry the gate 24 into the second position shown in phantom outline in FIGS. 2 and 3, in which the gate is urged by the snap-spring element 80 against the abutment 44.

Thus, the holding means in the form of the snap-spring 80 provides the gate with bi-stable equilibrium capability in that the snap-spring holds the gate 24 in a first position of stable equilibrium until sufficient force is applied to move the gate through an intermediate position to another position in which the snap-spring holds the gate in a second position of stable equilibrium.

Because of this structural arrangement of parts it is possible to apply a relatively short duration electrical impulse to solenoid 60 to provide an external force to move the gate from a first position of stable equilibrium through an intermediate position to a second position of stable equilibrium relying on the holding means, in the form of the snap-spring 80, to maintain the gate in the second position. No further external force is necessary until it is desired to return the gate to its first position which is accomplished by means of the second solenoid 62.

Thus, in contrast to conventional systems in which the gate must be moved from a first position and held in a second position by the application of external force for at least the full time duration for which the gate must be maintained in the second position, whereas, in this divertor assembly the application of external force for only short time durations is necessary and the gate is held in position without the application of force from an external power source.

Figure 15:
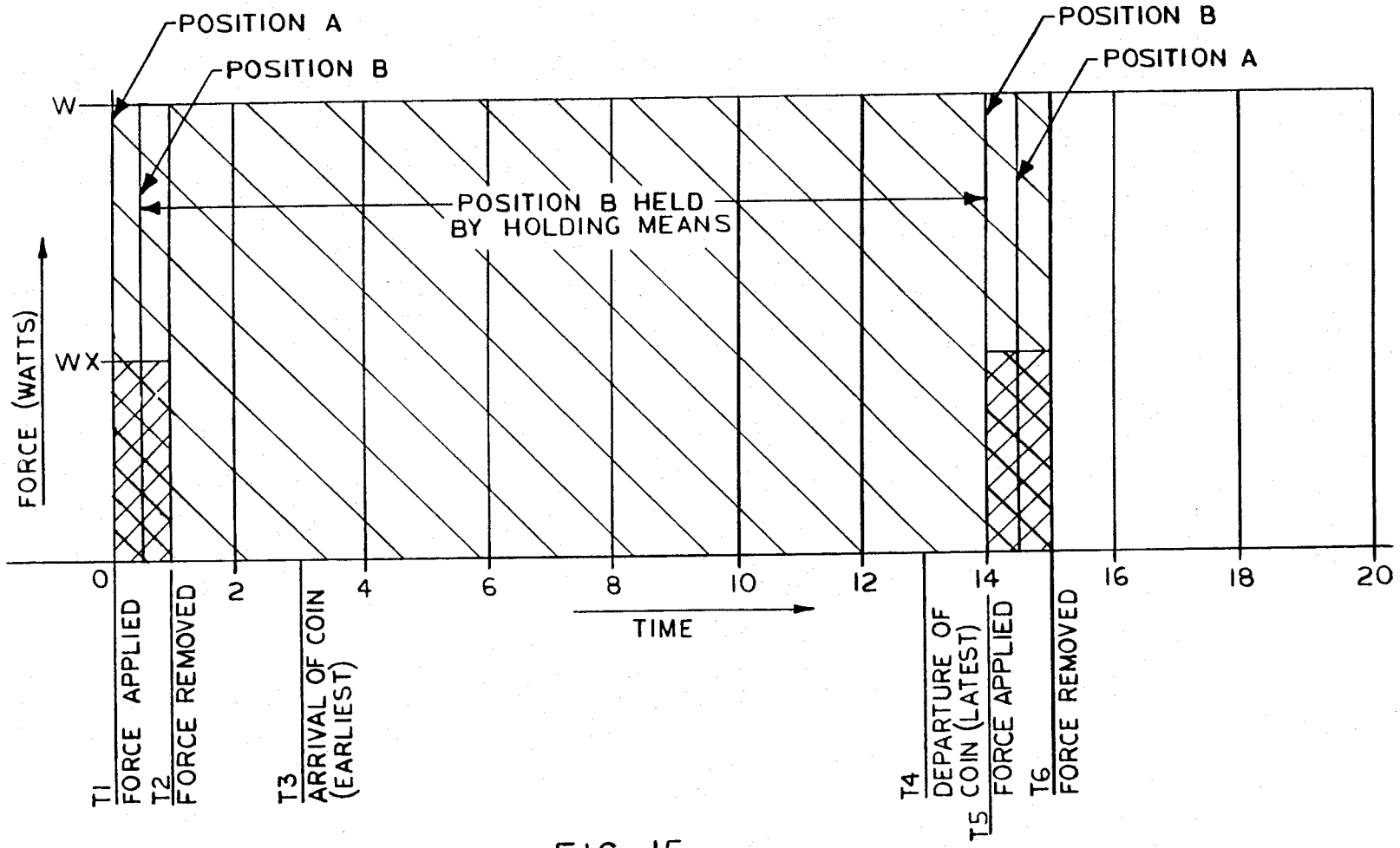
FIG. 15 is a diagrammatic representation of the energy usage.

FIG. 15 provides a graphic illustration of the difference between the conventional system and the improved system. In the conventional system, a holding force W of typically 2 to 4 watts, must be applied for a time period T6, typically 150 milliseconds, to permit the gate to remain in the second position a sufficient duration to allow the coin to pass before the force is released. In the improved system much smaller applied forces Wx (where x is less than 1), typically of the order of less than 2 watts, are required for two much smaller time periods of T1 to T2 and T5 to T6, each typically 10 milliseconds to achieve the same result of holding the gate in the desired position until the coin C has passed. The energy required in the conventional system is shown by the full area under the graph shown by single hatch lines, while the energy required for the improved system shown by the cross-hatched area is shown to be much smaller. In the examples provided the comparitive energy required for the improved system is substantially less than ten percent (10%) of that required for the conventional system.

Figure 14:
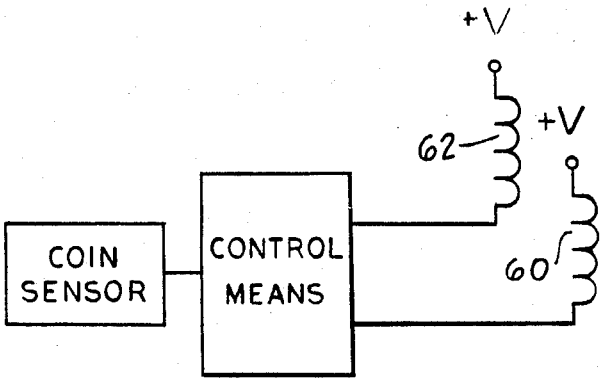
FIG. 14 is a block diagram of the control means associated with FIG. 1.

As will be readily understood, the electrical impulses supplied to the solenoids 60 and 62 can be triggered as by an upstream sensing device which responds to the sensing of the coin in a manner well-known to those skilled in the art. For example, as shown in FIG. 14 a control means responds to a coin sensor to initiate an impulse supplied to the solenoid 60 to move the gate 24 from its original position to its second position. The control means also includes a timing means to initiate an impulse supplied to the solenoid 62 to return the gate to its original position after a finite period. Alternatively, the gate can be returned to its original position as soon as the coin has passed by use of a downstream sensor (not shown).

In some circumstances, for example in the case of a telephone call box, it may be desirable to provide that the original position of the gate directs the coins into a non-acceptance path, for example a coin return path. In this way, when power is not available, such as in the event of a power failure, all coins would be returned to the operator. When power is available the control means would sense an acceptable coin and initiate the impulse to move the gate into the second, acceptance condition and maintain it in that condition by timing means, for a sufficient duration of time to receive several acceptable coins. The control means would also react to the sensing of a non-acceptable coin so that the passage of such a coin would also result in the gate returning to its first non-acceptance condition before the expiration of the time delay.

Figure 4:
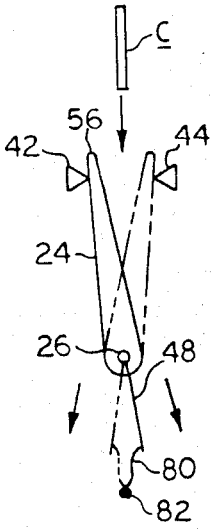
FIG. 4 is a schematic representation of the gate and spring holding means shown in FIG. 1.

The means tending to maintain the divertor member, gate 24, in a position of stable equilibrium shown in the embodiment described above with respect to FIGS. 1 and 2 is a snap-action spring element 80 shown schematically in FIG. 4. However, alternative holding means can be used as will now be described with reference to FIGS. 5–9, it being understood that a stable equilibrium condition is a condition in which the gate will remain unless moved by the application of external force.

Figure 5:
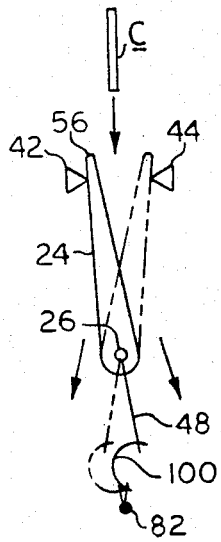
FIGS. 5–9 are schematics of alternative holding means.

The embodiment shown in FIG. 5 employs a holding means in the form of a "C" spring 100 of the type which is commonly used in electrical switching mechanisms and is utilized in substantially the same manner as the snap-spring 80 shown in FIGS. 1–4.

Figure 6:
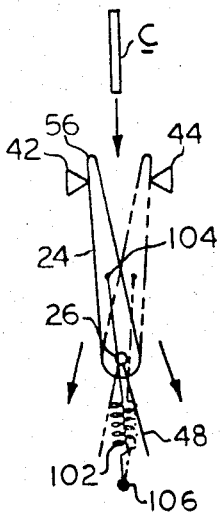

The embodiment shown in FIG. 6 employs a holding means in the form of a pre-tensioned spring 102 which is attached at one end to the gate 24, at a point 104 disposed between the gate hinge 26 and the remote end 56, and at the other end to a relatively fixed point 106. The effect of this arrangement is that the spring tension increases toward an intermediate or "top dead center" gate position and decreases beyond the intermediate position, the pretensioning providing a sufficient holding force to maintain the gate in stable equilibrium in both of the extreme positions against the abutments 42 and 44 respectively.

Figure 7:
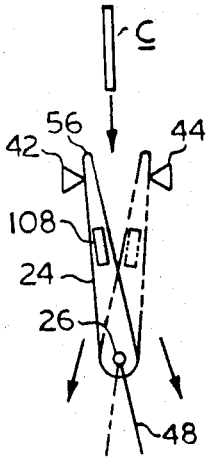

The embodiment shown in FIG. 7 employs a holding means in the form of a weight 108 disposed between the gate hinge 26 and the remote end 56 tending to urge the gate in a clockwise or counterclockwise direction depending on its disposition relative to the hinge 26 and the force of gravity and thereby provides a holding force tending to maintain the gate in stable equilibrium in both of the extreme positions.

Figure 8:
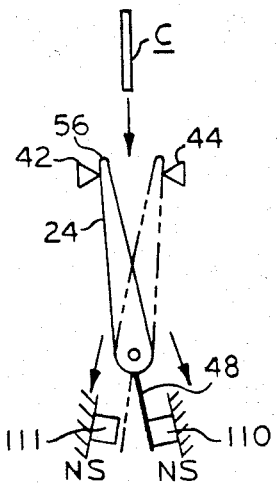

The embodiment shown in FIG. 8 employs a holding force in the form of opposed permanent magnets 110 and 111 fixedly attached to supports on each side of the gate, each magnet having sufficient magnetic force to hold a ferrous bracket 48 and maintain the gate in stable equilibrium in both of the extreme positions.

Figure 9:
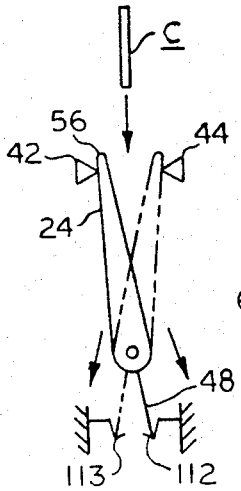

The embodiment shown in FIG. 9 employs a holding force in the form of opposed detents 112 and 113, provided in fixed supports on each side of the gate, each detent having sufficient frictional holding force to hold a compatibly configurated bracket 48 and maintain the gate in stable equilibrium in both of the extreme positions.

Figure 10:
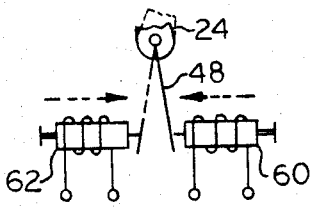
FIG. 10 is a schematic representation of the actuating means shown in FIG. 1.

It will be readily understood that the actuating force required to move the gate from one position of stable equilibrium to the other can be supplied by the dual solenoid arrangement used in the embodiment shown in FIGS. 1–4 which is shown schematically in FIG. 10. However, alternative actuating means can be used as will now be described with reference to FIGS. 11–13.

Figure 11:
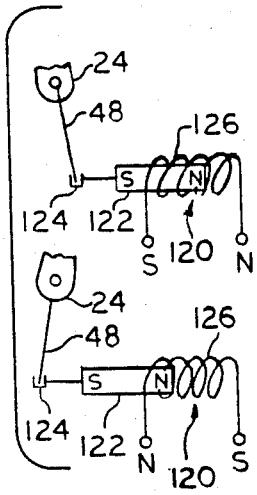
FIGS. 11–13 are schematics of alternative actuating means.

The embodiment shown in FIG. 11 employs an actuating means in the form of a single solenoid 120 having a movable plunger 122 with North and South polarity as shown. The plunger 122 is provided with an extension arm 124 engageable with bracket 48, said arm 124 being movable to the left or the right depending on the direction of the current flow through the field windings 126, which can be selectively reversed. Movement of the plunger 122 to the left results in the gate being moved clockwise from a first to a second position while movement of the plunger to the right results in the gate being returned to the first position. The movement of the plunger in each case is arrested by the stop means, such as the abutments 42 and 44, which limit movement of the gate 24 and the bracket 48.

Figure 12:
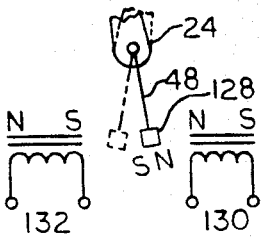

The embodiment shown in FIG. 12 employs an actuating means in the form of a permanent magnet 128 which is repelled or attracted depending on whether electro-magnet 130 or 132 is energized. The same result could be achieved with a single electro-magnet using reversal of polarity.

Figure 13:
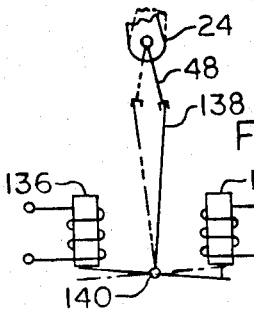

The embodiment shown in FIG. 13 employs an actuating means similar to that of FIG. 10 in that it provides two solenoids 134 and 136 which can be selectively energized. However, distinguishing from FIG. 10 the solenoids are energized to move a bell crank 138 which is pivoted at 140 and linked at its remote end to the bracket 48.

It will be understood that each of the actuating means described above can be used in conjunction with any of the holding means to move the gate 24 and maintain it in its two positions of stable equilibrium.

It will also be understood that neither the holding means nor the actuating means is limited to those embodiments described and other means can be used well within the scope of the invention herein claimed. Combinations of the holding means generally described above can be used in which, for example, a gravity type of holding means (such as shown in FIG. 7) can be used to hold the gate 24 in one position and magnetic type of holding means (such as shown in FIG. 8) can be used to hold the gate 24 in the other position.

I claim as my invention:

1. A coin divertor assembly comprising:

(a) a body defining a coin-entry path and first and second coin-exit paths, (b) a divertor member mounted to the body and movable between a first, coin-diverting stable equilibrium position leading from the coin-entry path to the first coin-exit path and a second coin-diverting stable equilibrium position leading from the coin-entry path to the second coin-exit path, (c) holding means tending to maintain the divertor member in a position of stable equilibrium, and (d) actuating means selectively providing an impulse force to move the divertor member from the first position of stable equilibrium to the second position of stable equilibrium, (e) the holding means being a snap-action spring, (f) the divertor member being a gate including a hinge, a remote end and an intermediate portion disposed between said hinge and remote end, (g) the body including a fixed support portion, and (h) the snap-action spring being a pretensioned spring extending between and attached to the gate intermediate portion and the support portion.

2. A coin divertor assembly comprising:

(a) a body defining a coin-entry path and first and second coin-exit paths, (b) a divertor member mounted to the body and movable between a first, coin-diverting stable equilibrium position leading from the coin-entry path to the first coin-exit path and a second coin-diverting stable equilibrium position leading from the coin-entry path to the second coin-exit path, (c) holding means tending to maintain the divertor member in a position of stable equilibrium, and (d) actuating means selectively providing an impulse force to move the divertor member from the first position of stable equilibrium to the second position of stable equilibrium, (e) the divertor member being a gate including a hinge, a remote end and an intermediate portion disposed between said hinge and said remote end, and (f) the holding means including a weight disposed between the gate intermediate portion and the support portion.

3. A coin divertor assembly comprising:

(a) a body defining a coin-entry path and first and second coin-exit paths, (b) a divertor member mounted to the body and movable between a first, coin diverting stable equilibrium position leading from the coin-entry path to the first coin-exit path and a second coin-diverting stable equilibrium position leading from the coin-entry path to the second coin-exit path, (c) holding means providing a holding force acting on the divertor member and tending to maintain the divertor member in a position of stable equilibrium, and (d) impulse actuating means selectively providing alternately first and second short duration impulse forces succeeding each other, the first impulse force overcoming the holding force and moving the divertor member from the first position of stable equilibrium to the second position of stable equilibrium and the second impulse force overcoming the holding force and returning the divertor member to said first position, the holding force holding the divertor member in each of said first and second positions between said short duration impulse forces.

4. A coin divertor assembly as defined in claim 3, in which:

(e) the holding means is a snap-action spring.

5. A coin divertor assembly as defined in claim 3, in which:

(e) the actuating means includes a solenoid having a plunger operatively engageable with the divertor member.

6. A coin divertor assembly as defined in claim 4, in which:

(f) the snap-action spring is a "C" spring.

7. A coin divertor assembly as defined in claim 3, in which:

(e) the divertor member is a gate and includes opposed side portions, (f) the body includes support portions disposed on each side of the opposed gate portions, and (g) the holding means includes at least one magnetic element attached to one of said gate and body portions.

8. A coin divertor assembly as defined in claim 3, in which:

(e) the divertor member includes engagement means, and (f) the holding means includes spaced support means engageable with the body in frictional relation.

9. A coin divertor assembly as defined in claim 3, in which:

(e) the actuating means includes at least two solenoids each having a plunger operatively engageable with the divertor member.

10. A coin divertor assembly as defined in claim 3, in which:

(e) actuator means includes a permanent magnet mounted to the divertor member and at least one electro-magnet mounted to the body adjacent said permanent magnet.

11. A coin divertor assembly as defined in claim 3, in which:

(e) the actuator means include opposed solenoids disposed in spaced relation and a bell crank having opposed arms selectively engageable by the solenoid plungers and an intermediate arm engageable with the divertor member.

12. A coin divertor assembly as defined in claim 3, in which:

(e) the first impulse force is initiated by the sensing of an acceptable coin and the second impulse force is initiated by the sensing of any one of a plurality of events.

13. A coin divertor assembly as defined in claim 3, in which:

(e) the first impulse force is initiated by the sensing of an acceptable coin and the second impulse force is initiated by the sensing of an unacceptable coin.

14. A coin divertor assembly comprising:

(a) a body defining a coin-entry path and first and second coin-exit paths, (b) a divertor member mounted to the body and movable between a first, coin diverting stable equilibrium position leading from the coin-entry path to the first coin-exit path and a second coin-diverting stable equilibrium position leading from the coin-entry path to the second coin-exit path, (c) holding means tending to maintain the divertor member in a position of stable equilibrium, (d) impulse actuating means selectively providing alternating first and second impulse forces succeeding each other, the first impulse force moving the divertor member from the first position of stable equilibrium to the second position of stable equilibrium and the second impulse force returning the divertor member to said first position, (e) the divertor member being a gate including a hinge having a remote end, (f) the holding means including a weight disposed between the hinge axis and the remote end, and (g) the body including spaced abutment portions selectively engageable by the gate so the gate is held by gravity in each of the stable equilibrium positions.

* * * * *